United States Patent [19]

Whittaker et al.

[11] Patent Number: 4,920,324

[45] Date of Patent: Apr. 24, 1990

[54] HIGH POWER RF SWITCH

[75] Inventors: Neil Whittaker, Hudson; Denis Boulanger, Montreal, both of Canada

[73] Assignee: Canadian Patents and Development Limited/Societe Canadienne Des Brevets Et D'Exploitation Limitee, Canada

[21] Appl. No.: 190,424

[22] Filed: May 5, 1988

[30] Foreign Application Priority Data

May 5, 1987 [CA] Canada ..... 536435

[51] Int. Cl.[5] ..... H01P 1/10; H01P 5/12

[52] U.S. Cl. ..... 333/106; 200/600

[58] Field of Search ..... 200/52 R, DIG. 1, 153 S, 200/600; 333/1.1, 102, 105, 106, 107, 99 MP, 262, 24 C, 259; 361/287, 288, 289

[56] References Cited

U.S. PATENT DOCUMENTS

| | | | |
|---|---|---|---|
| 2,879,483 | 3/1959 | Montani | 333/106 |
| 3,227,969 | 1/1966 | Bentley | 200/153 S |
| 3,598,933 | 8/1971 | Walser | 200/DIG. 1 |
| 3,969,690 | 7/1976 | Hansen et al. | 333/107 |
| 4,158,216 | 6/1979 | Bigelow | 200/600 |
| 4,206,332 | 6/1980 | Veenendaal | 200/153 S |

*Primary Examiner*—J. R. Scott

*Attorney, Agent, or Firm*—Sughrue, Mion, Zinn, Macpeak & Seas

[57] ABSTRACT

An RF switch for use e.g. in space has a pair of rotary switch contacts mounted for rotation into and out of a closed position in which a switch connection is established between the switch contacts. A dielectric material is located between the switch contacts, the dielectric material and the switch contacts constituting a capacitive RF connection between the switch contacts in the closed position to eliminate multipactor discharge and ionization and to improve heat dissipation.

5 Claims, 2 Drawing Sheets

HIGH POWER RF SWITCH

BACKGROUND OF THE INVENTION (a) Field of the Invention

The present invention relates to RF switches and is useful in particular, but not exclusively, for RF switches intended for use in space.

(b) Description of Related Prior Art

It is known that RF switches employed in space, where they are required to operate in a vacuum or a near vacuum, are subjected to special problems, including multipactor discharge, corona discharge and elevated temperatures.

Multipactor discharge is a resonant RF discharge which is sustained by the emission of secondary electrons from discharging surfaces. It is known (see P. F. Clancey, "Multipactor Control in Microwave Space Systems", Microwave Journal, Volume 21, March 1978, pp. 77–83) that three conditions are required to produce multipactor discharge, these conditions being (1) that the multipacting gap must in vacuum; (2) that the secondary electron emission coefficient of the surfaces, which depends on the type of surfaces, their cleanliness and their electron energy, must be greater than unity; and (3) that the RF power, the gap spacing and the frequency must be such as to ensure resonance between the electron motion and the field.

The corona discharge is also determined by the spacing, the signal frequency, and the power, and in addition requires a low level vacuum, and is unlikely to occur in a switch provided with good venting and employing materials that do not out-gas significantly, even at elevated temperatures.

Switches are also required to dissipate heat in order to avoid elevating internal parts of the switches.

It has previously been proposed to employ, as a high power switch for space use, a switch employing a metallic reed forming a transmission line between two points to be connected (see U.S. Pat. No. 4,317,972, issued Mar. 2, 1982 to Evert Kjellberg). The metallic reed provided in this prior art switch is activated by means of solenoids and is surrounded by a dielectric material. It has been found, however, that such a switch tends to be unreliable in use, apparently as a result of multipactor discharge and poor thermal conductivity.

SUMMARY OF THE INVENTION

It is accordingly an object of the present invention to provide a novel and improved RF switch which eliminates multipactor discharge.

It is a further object of the present invention to provide an RF switch which enables improved heat dissipation from the region between the switch contacts.

According to the present invention there is provided, in an RF switch comprising a pair of switch contacts and means mounting the switch contacts for rotary movement into and out of a closed position in which a switch connection is established between the switch contacts, the improvement comprising a tuned RF circuit formed on rotatable dielectric material located between the switch contacts, the dielectric material and the switch contacts constituting a capacitive RF connection between the switch contacts in the closed position.

In a preferred embodiment of the invention, first and second pairs of switch contacts are provided, with a transmission line connecting the first pair of contacts together and with RF signal conductors respectively connected to the second pair of switch contacts. The first pair of switch contacts are rotatable to and fro between a closed position in which a switch connection is established between respective ones of the first and second pairs of switch contacts, and dielectric material is fixed on a switch contact support between the first and second pairs of switch contacts so that the first pairs of switch contacts are separated by the dielectric material from the second pair of switch contacts. In the closed position, the first and second pairs of switch contacts and the dielectric material cooperate to form a capacitive RF signal path between the RF signal conductors.

In this way, the switch contacts are isolated from one another by the dielectric material, so that ionization and multipactor breakdown are counteracted.

Also, the dielectric material provides an effective heat path for dissipation of heat from the area of the switch contacts.

The present invention may be applied to a wide range of switch configurations.

However, in a preferred embodiment of the invention a first group of switch contacts are provided on a movable support of dielectric material and are connected together in pairs, while a second group of switch contacts are provided in a stationary mounting and connected to respective RF conductors. The dielectric material support is rotatable relative to the second group of switch contacts to align different interconnected pairs of the contacts of the first group with respective contacts of the second group in different respective switching positions of the rotatable support. More particularly, the first group of switch contacts comprises a central contact connected by a microstrip, constituting a transmission line, to one of three other switch contacts which are equiangularly spaced about the axis of rotation of the dielectric material support, the other two of such switch contacts being connected together by a transmission line in the form of a microstrip, and the switch contacts of the second group are arranged in a similar array.

The capacitive path, as explained in greater detail below, forms a resonant series LC circuit acting as a band-pass filter, with the switch contacts forming reactive elements.

BRIEF DESCRIPTION OF THE DRAWINGS

The invention will be more readily understood from the following description of a preferred embodiment thereof given, by way of example, with reference to the accompanying drawings, in which.

DESCRIPTION OF THE PREFERRED EMBODIMENTS

Figure 1:
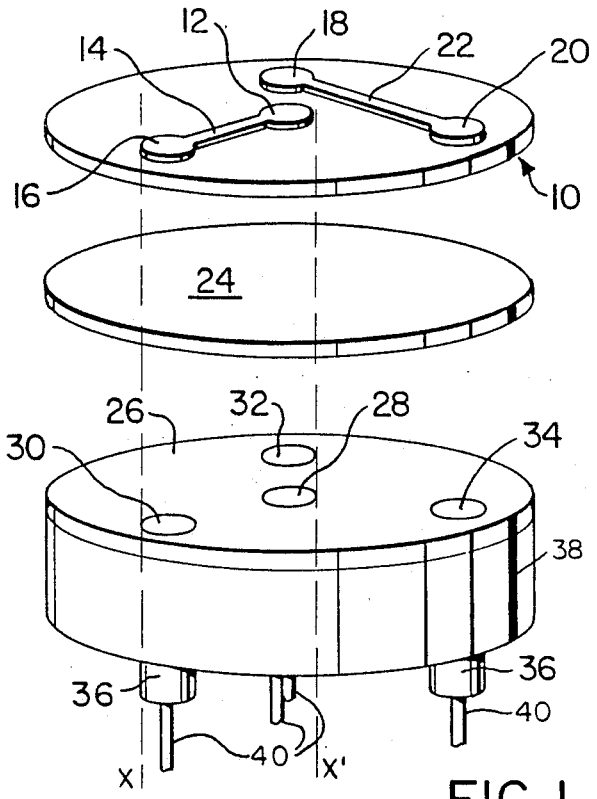
FIG. 1 shows an exploded view, in perspective, of the main components of an RF switch embodying the present invention.

The switch components shown in FIG. 1 comprise a rotatable switch contact support indicated generally by reference numeral 10, which is formed as a disk of an alumina ceramic dielectric material, e.g. aluminum oxide.

The rotatable switch contact support 10 forms a metalized substrate on which pairs of switch contacts (capacitive areas), connected by microstrip transmission lines, are formed by etching.

More particularly, the rotatable switch contact support 10 has a central switch contact area 12, which is coaxial with the rotatable switch contact support 10 and which is connected by a microstrip transmission line 14 to a further switch contact area 16 located close to the periphery of the rotatable switch contact support 10.

The switch contact area 16 is one of three switch contact areas 16, 18 and 20 which are equiangularly distributed about the center of the rotatable switch contact support 10, i.e. at angles of 120°, and the switch contact areas 18 and 20 are connected to one another by a microstrip transmission line 22.

Below the rotatable switch contact support 10 there is shown a disk 24 of dielectric material, the purpose of which is described below, and beneath the dielectric material disk 24 there is shown a stationary switch contact support 26, in which four switch contact areas 28, 30, 32 and 34, in the form of circular discs, are recessed, the switch contact areas 28, 30, 32 and 34 being arranged in an array corresponding to that of the switch contact areas 12, 16, 18 and 20, i.e. with the switch contact area 28 in the center of the stationary switch contact support 26 and with the switch contact areas 30, 32, and 34 equiangularly distributed around the center of the stationary switch contact support 26.

The stationary switch contact support 26 is made of a dielectric material, e.g. Rexolite (trade mark), which is mounted on an aluminum base plate 38.

By means of coaxial connectors 36 and 40, the switch contact areas 28, 30, 32 and 34 are connected to respective coaxial connector center conductors 40.

The dielectric material disk 24 is fixed on the stationary switch contact support 26 between the rotatable switch contact support 10 and the stationary switch contact support 26 in order to avoid possible abrasion of the switch contact areas 28, 30, 32 and 34 by the rotatable switch contact support 10 on rotation of the latter relative to the stationary switch contact support 26 during operation of the switch.

Figures 4A, 4B, 4C, 5, 6:
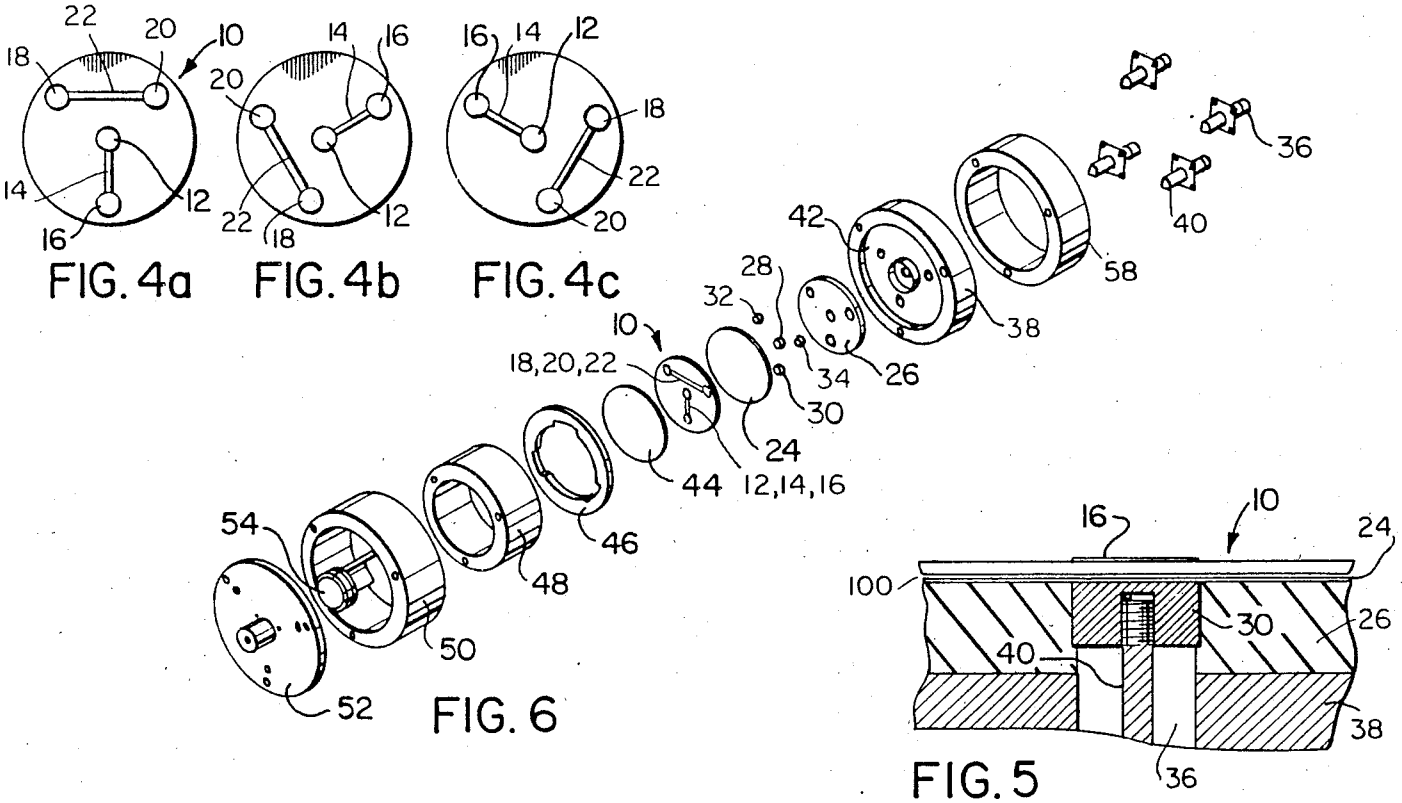
FIGS. 4*a* to 4*c* show a diagrammatic plan view of a rotatable switch contact support member forming part of the switch components of FIG. 1 indicating the three positions of this particular configuration of switch.
FIG. 5 shows a view in cross-section through a pair of switch contacts of the switch of FIGS. 1 to 4.
FIG. 6 shows an exploded view, in perspective, and in greater detail, of the switch.

Referring now to FIGS. 4*a* to 4*b*, which, show a diagrammatic view of the switch contact areas with different switching positions. In the first position shown in FIG. 4*a* the switch contact areas 12 and 16 and their interconnecting microstrip transmission line 14 provide an interconnection between the switch contact areas 28 and 30, of the stationary switch contact support 26, whereas the switch contact areas 18 and 20 and the microstrip 22 interconnect the switch contact areas 32 and 34.

It will be readily apparent that FIGS. 4*b* and 4*c* represent two other switching states in which different pairs of the switch contacts in the stationary switch contact support 26 are interconnected.

In any one of these switching positions, the switch contacts and microstrip transmission lines on the rotatable switch contact support 10 cooperate with the switch contacts in the stationary switch contact support 26 and with the dielectric material therebetween, i.e., the material of the rotatable switch contact support 10 and that of the disk 24, to provide capacitive signal connection paths between the respective ones of the coaxial connector center conductors 40.

Figure 2:
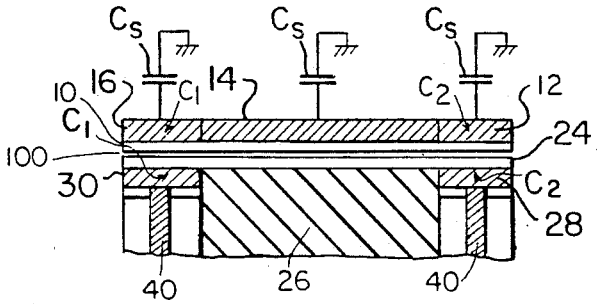
FIG. 2 shows a diagrammatic view taken in cross-section between the lines x and x through the switch components of FIG. 1.
Figure 3:
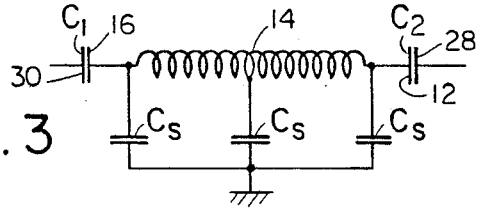
FIG. 3 is a circuit diagram showing the electrical configuration of the switch components of FIGS. 1 and 2.

These capacitive connections will be more apparent by reference to FIGS. 2 and 3.

FIG. 2 shows a view in cross-section through the switch contact areas 12 and 16 and their interconnecting microstrip transmission line 14, with these two switch contact areas disposed in a switching position, in which they are in alignment with the switch contact areas 28 and 30, respectively, of the stationary switch contact support 26.

The switch contact areas 16 and 30, and the dielectric material interposed therebetween, i.e. the rotatable switch contact support 10 and the disk 24, form a capacitor C1, and the switch contact areas 12 and 28 likewise form a capacitor C2, while the microstrip transmission line 14 acts as an inductor connecting the capacitors C1 and C2 in series, as represented in FIG. 3. Capacitances Cs in parallel with one another, also shown in FIG. 3, are stray capacitances to the housing.

It will be appreciated that the value of the capacitances C1 and C2 is determined by the thicknesses and the dielectric constants of the rotatable switch contact support 10 and the disk 24, and also of a small air gap 100 between the rotatable switch contact support 10 and the disk 24, whereas the value of the inductor is determined by the width and length of the microstrip transmission line 14.

The dielectric materials employed in the switch are space qualified, and that of the rotatable switch contact support 10 is selected to provide a high dielectric constant, a good dissipation factor and sufficient thermal conductivity and low out-gassing. The high thermal conductivity is required to conduct away the heat produced by conductor losses of the microstrip transmission lines etched on the rotatable switch contact support 10, and the dissipation factor is important to minimize the insertion of loss of the switch.

To satisfy these criteria, alumina is employed for the rotatable switch contact support 10 in the present embodiment, but it is mentioned that other suitable dielectric materials, e.g. beryllium oxide or aluminum nitride, may be utilized.

The thickness of the stationary switch contact support 26 determines the value of the inductance between the contact areas 12–16 and 18–20. The thicker the stationary switch contact support 26, the higher the impedance transmission line and the higher the inductance. A low dielectric constant is preferable for the stationary switch contact support 26 in order to provide good capacitive isolation between the switch contacts, and a low dissipation factor is required to minimize insertion loss.

The dielectric material 24, provided between the rotatable switch contact support 10 and the stationary switch contact support 26, prevents mechanical abrasion and RF breakdown, and also has a high dielectric strength, low out-gassing characteristics, a low dissipation factor and a low dielectric constant. To satisfy these requirements, a Kapton (trade mark) film has been employed in view of its ready availability.

Referring now to FIG. 5, which shows by way of example a cross-section through the stationary switch contact area 30, it will be seen that the switch contact area 30 is in threaded engagement with the center conductor 40 of the respective coaxial connector 36. The moveable switch contact area 16 is shown in vertical alignment with the stationary switch contact area 30.

Further details of the preferred embodiment of the invention are apparent from FIG. 6, from which there can be seen a base plate 38 surmounts a torus shaped member 58 which encircles the coaxial conductors 40, the base plate 38 being provided with a shallow cylindrical recess 42 for snugly receiving the stationary switch contact support 26.

The rotatable switch contact support 10 is interposed between the dielectric material disk 24, and a similar dielectric material disc 44 and is mounted on a carrier 46 made of Kovar (trade mark).

The carrier 46 is mounted on an inner cylinder 48, which is rotatable within an outer cylinder 50 provided with a cover 52 and an isolation barier 54.

While a preferred embodiment of the invention has been described above, it will be understood that the present invention is not limited to the features of that embodiment but may vary within the scope of the following claims.

The embodiments of the invention in which an exclusive property or privilege is claimed are defined as follows:

We claim:

1. In an RF switch comprising a pair of switch contacts and means mounting said switch contacts for rotary movement into and out of a closed position in which a switch connection is established between said switch contacts, the improvement comprising a tuned RF circuit formed on rotatable dielectric material located between said switch contacts, said dielectric material and said switch contacts constituting a capacitive RF connection between said switch contacts in said closed position.

2. An RF switch comprising:

at least first and second pairs of switch contacts;

means forming a transmission line between said first pair of contacts;

RF signal conductor means respectively connected to said second pair of switch contacts for the passage of RF signals to and from said switch;

means mounting said first pair of switch contacts for rotary movement to and from a closed position in which a switch connection is established between said first and second pairs of switch contacts; and dielectric material fixed on a rotatable switch contact support between said first and second pairs of switch contacts so that said first switch contacts are separated by said dielectric material from said second switch contacts and in said closed position form therewith a capacitive RF signal path between said RF signal conductor means.

3. An RF switch as claimed in claim 2, wherein said first and second pairs of switch contacts, said transmission line means and said dielectric material form a band pass filter in said closed position.

4. An RF switch as claimed in claim 2 comprising a first group of rotatable switch contacts, means forming transmission lines between pairs of rotatable switch contacts, said dielectric material comprising means for supporting said rotatable switch contacts and said transmission line means for rotation to a plurality of different switching positions, and a second group of stationary switch contacts, said first and second groups including said first and second pairs and said pairs of said first group connected by said transmission lines cooperating with respective pairs of said second group, in respective ones of said switching positions, to form respective capacitive RF signal paths through said switch.

5. An RF switch as claimed in claim 2, wherein said dielectric material comprises means rotatably supporting said first pair of switch contacts and stationary protective means interposed, between said means rotatably supporting said first pair of switch contacts and said second pair of switch contacts, for preventing abrasion of said second pair of switch contacts by movement of said support means.

* * * * *